US006942098B1

(12) United States Patent
Dodge

(10) Patent No.: US 6,942,098 B1
(45) Date of Patent: Sep. 13, 2005

(54) STORAGE DEVICE FOR FACE PROTECTION GEAR

(76) Inventor: Charles Dodge, 8533 W. Diana Ave., Peoria, AZ (US) 85345

( * ) Notice: Subject to any disclaimer, the term of this patent is extended or adjusted under 35 U.S.C. 154(b) by 62 days.

(21) Appl. No.: 10/610,659

(22) Filed: Jul. 1, 2003

(51) Int. Cl.[7] ..... A47F 7/00
(52) U.S. Cl. ..... 206/470; 211/106.01; 211/203; 312/327; 312/351.5
(58) Field of Search ..... 206/461, 462, 206/464, 470, 471, 477, 776; 211/85.9, 89.01, 211/106.01, 203; 312/245, 248, 326, 327, 312/351.5

(56) References Cited

U.S. PATENT DOCUMENTS

| | | | | |
|---|---|---|---|---|
| 258,720 | A * | 5/1882 | Dickson | 223/107 |
| 535,685 | A * | 3/1895 | Dunstane | 248/462 |
| 1,380,747 | A * | 6/1921 | Stanford et al. | 211/1 |
| 2,551,305 | A * | 5/1951 | Tompkins | 312/328 |
| 2,642,331 | A * | 6/1953 | Sprinkle | 312/283 |
| 3,445,860 | A | 5/1969 | Rodell | |
| 4,033,648 | A * | 7/1977 | Lopez-Cepero | 312/100 |
| 4,326,761 | A * | 4/1982 | Schwartz | 312/326 |
| 5,732,414 | A | 3/1998 | Monica | |
| 6,053,321 | A | 4/2000 | Kayser | |
| 6,065,589 | A | 5/2000 | Ouwens | |
| 6,241,208 | B1 | 6/2001 | Lin | |
| 6,308,832 | B1 | 10/2001 | Pirro et al. | |
| 6,422,671 | B1 * | 7/2002 | Lodge et al. | 312/245 |

* cited by examiner

*Primary Examiner*—John A. Ricci
(74) *Attorney, Agent, or Firm*—Frank J. McGue

(57) ABSTRACT

A storage device for storing and protecting face protection equipment includes a base plate and a cover rotatably mounted to the base plate. The cover and the base plate define a space sized to cover an article of face protection equipment. The cover rotates between an open position whereby the space is accessible and a closed position whereby the space is not accessible. One or more attachment devices are provided for releasably mounting one or more articles of face protection equipment to the base plate in the space.

18 Claims, 2 Drawing Sheets

STORAGE DEVICE FOR FACE PROTECTION GEAR

TECHNICAL FIELD

This invention relates generally to the field of storage devices, and, more particularly, to storage devices for use in connection with face protection gear in manufacturing and workshop environments.

BACKGROUND OF THE INVENTION

Face protection equipment is a required element in many workplace environments. Face protection equipment includes, but is not limited to, face shields, welding helmets and safety glasses. One problem encountered in the workplace is storage of face protection equipment when not needed, for example, during breaks and after work. Often, such equipment is simply laid on work benches or in lockers or, in some cases, on the floor until needed again. This subjects face protection equipment to damage from tools, dropping, paint, and the like. Thus, there is a need for a storage device to easily and removably hold face protection equipment and protect same in the workplace.

There have been a number of storage devices described in the art. For example, U.S. Pat. No. 6,308,832 entitled "Product Display Package" which issued on Oct. 30, 2001 to Pirro et al. discloses a display package for retaining product includes a housing having a compartment for housing product and a lid for covering said compartment.

U.S. Pat. No. 5,732,414 entitled "Helmet Having a Readily Removable and Replaceable Protective Layer" which issued to Mar. 31, 1998 to Monica shows a helmet having a polymeric protective layer attached thereto.

U.S. Pat. No. 3,445,860 entitled "Detachable Cover for Helmets and the Like" which issued on May 27, 1969 to Rodell shows a detachable cover for crash helmets which is attachable to the helmet itself.

U.S. Pat. No. 6,065,589 entitled "Presentation Elements" which issued on May 23, 2000 to Ouwens relates to a presentation element having a first element with a central portion for accommodating an article and a second element with a deformable central portion which covers the article, the second element being movable to cover the first element.

U.S. Pat. No. 6,053,321 entitled "Blister Pack Display Card with Reusable Container" which issued on Apr. 25, 2000 to Kayser has a reusable container mounted on a display card. The reusable container has a tray and a lid.

U.S. Pat. No. 6,241,208 entitled "Structure for Mounting a Hand Tool in a Hanging Package" which issued on Jun. 5, 2001 to Lin includes a base plate, a semi-circular member having a neck connecting the semi-circular member to the base plate and two tubular pins fixedly arranged thereon to mount a hand tool.

None of the known prior art disclose the combination set forth herein.

SUMMARY OF THE INVENTION

It is an object of this invention to provide a storage device for face protection equipment which protects same when not in use.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
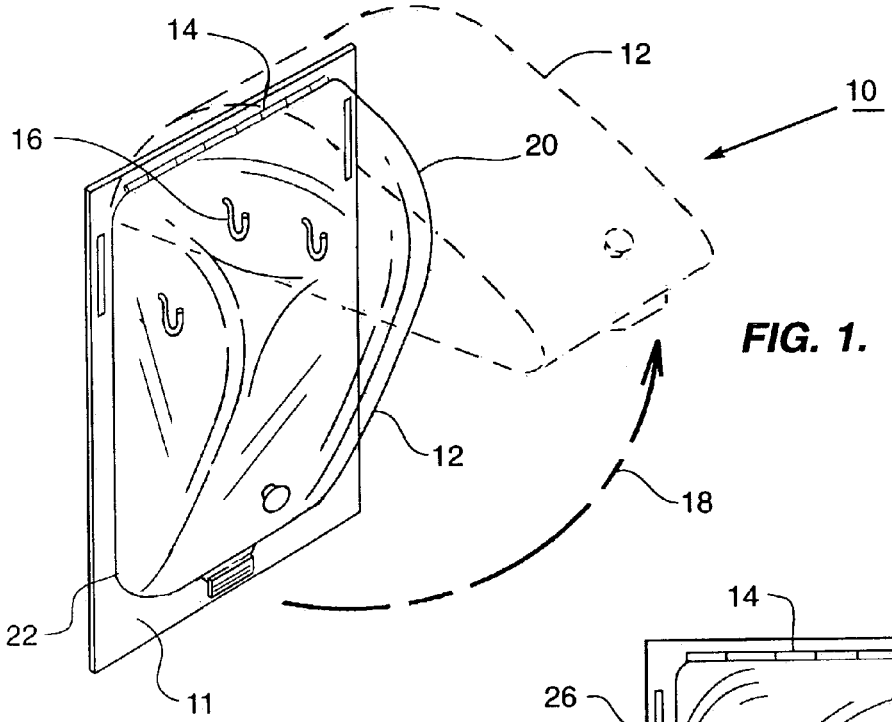
FIG. 1 is a perspective view of the present invention.
Figure 2:
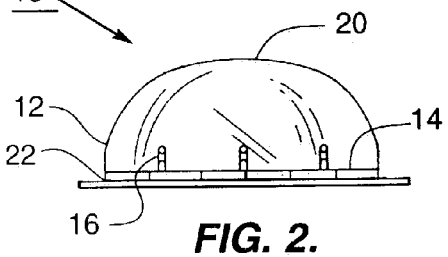
FIG. 2 is a top view of the invention of FIG. 1.
Figure 3:
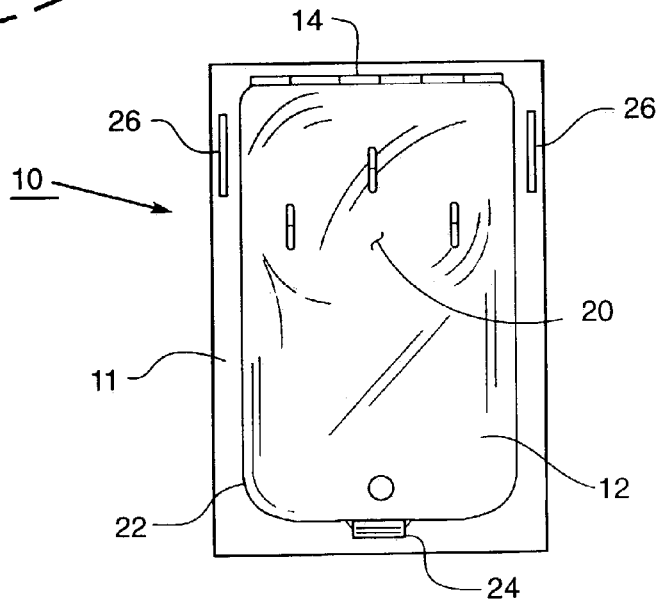
FIG. 3 is a front view of the invention of FIG. 1.

Referring more particularly to the drawings by characters of reference, FIGS. 1–3 disclose combinations of features which constitute the components of a storage device 10 of the present invention. Storage device 10 comprises a base plate 11 and a cover 12. Cover 12 has a hinge 14 along one edge thereof mounting cover 12 to base plate 11. One or more attachment devices 16, in the presently preferred embodiment J-hooks, are mounted to base plate 11.

As best seen in FIGS. 1–3, the presently preferred embodiment hinge 14 is mounted along a top edge of cover 12. This allows gravity to pull cover 12 to the closed position. However, in an alternate embodiment of FIG. 5, hinge 14' is side mounted to cover 12' in device 10'. The position of hinge 14 or 14' can be placed as desired on base plate 11.

As best seen in FIG. 1, cover 12 preferably presents a central dome 20 preferably oriented to the upper portion of cover 12. Cover 12 further includes a rim 22 extending about the periphery of dome 20. In a closed position (solid lines in FIG. 1), an article of face protection equipment (not shown) hangs from attachment device 16 and is completely covered by a space defined by base plate 11 and central dome 20. In the open position (in shadow in FIG. 1), a user can easily access the article as needed. Hinge 14 allows cover 12 to move between the open position and the closed position and vice versa by rotation along arrow 18. In one embodiment, a latch 24 is positioned opposite hinge 14 to engage rim 22 in the closed position to prevent unwanted movement of cover 12. Latch 24 is any suitable releasable construction including, but not limited to, a hook and loop fastener.

Figure 4:
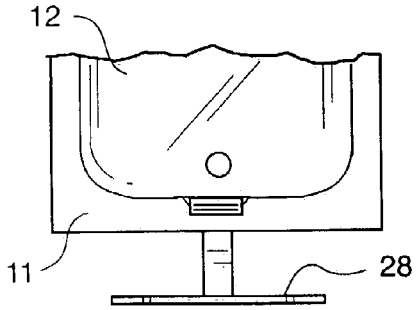
FIG. 4 is front view of an alternate embodiment of the invention of FIG. 1.
Figure 5:
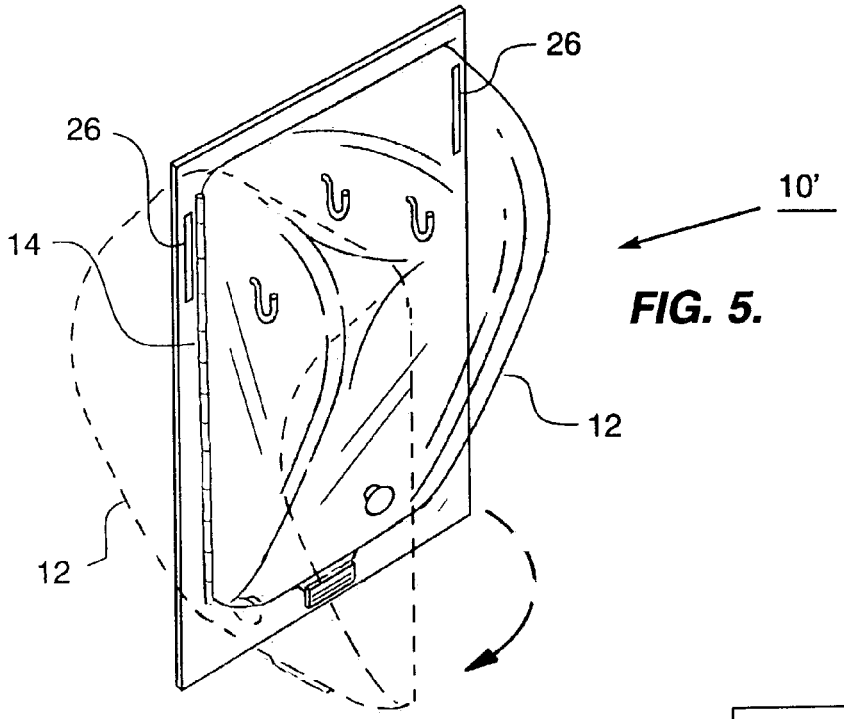
FIG. 5 is a perspective view of an alternate embodiment of the invention.
Figure 6:
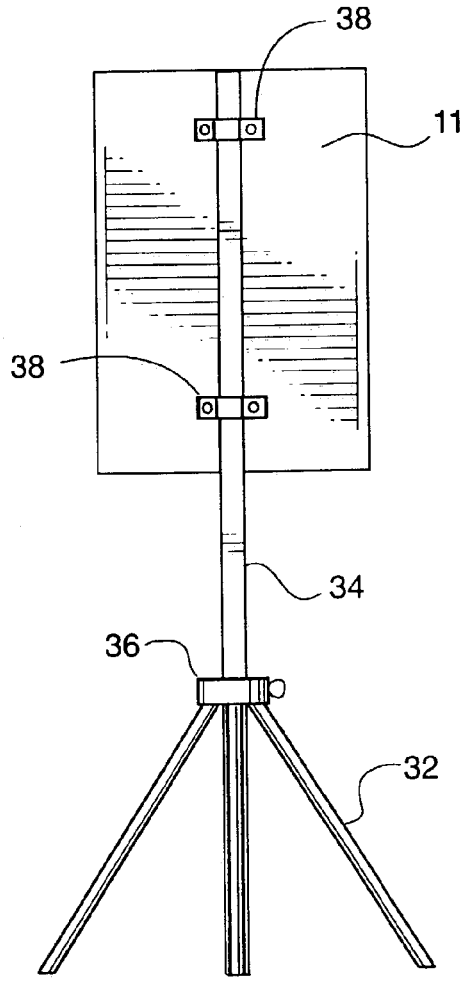
FIG. 6 is rear view of another embodiment of the invention.

To position device 10 in the workplace, a number of mounting options are possible. As best seen in FIGS. 3 and 5, one or more slots 26 are provided which allows a user to mount device 10 to a suitable available surface such as a wall or the like. As shown in FIG. 4, a pedestal 28 and post 30 extending upwardly therefrom can engage the bottom of base plate 11 to provide a free standing mount suitable for use on a horizontal surface. As shown in FIG. 6, a tripod 32 has a slidable post 34 extending upwardly from a collar 36 to engage mounting brackets 38 affixed to the rear of base plate 11. The embodiments of FIGS. 4 and 6 provide an easily movable storage device 10.

Although only certain embodiments have been illustrated and described, it will be apparent to those skilled in the art that various changes and modifications may be made therein without departing from the spirit of the invention or from the scope of the appended claims.

What is claimed is:

1. A storage device for storing and protecting face protection equipment comprises:

a base plate and a cover rotatably mounted to the base plate, the cover and the base plate defining a space sized to cover an article of face protection equipment, the cover having an open position whereby the space is accessible and a closed position whereby the space is not accessible, one or more attachment devices adapted to releasably mount one or more articles of face protection equipment to the base plate in the space, and a tripod mount having a slidable post extending upwardly from a collar, the slidable post engaging one or more mounting brackets affixed to the rear of the base plate.

2. The storage device of claim 1 wherein the attachment devices are J-hooks.

3. The storage device of claim 1 wherein a hinge rotatably connects the cover and the base plate.

4. The storage device of claim 3 wherein the hinge is mounted to the top of the cover.

5. The storage device of claim 3 wherein the hinge is mounted to the side of the cover.

6. The storage device of claim 1 wherein the cover has a central dome and a rim extending about the periphery of the central dome, the space being defined by the central dome and the base plate.

7. The storage device of claim 6 wherein hinge rotatably connects the cover and the base plate, and a latch is positioned opposite the hinge to engage the rim in the closed position thereby preventing unwanted movement of the cover.

8. The storage device of claim 7 wherein the latch is a hook and loop fastener.

9. The storage device of claim 1 adapted to mount to a surface.

10. The storage device of claim 9 having slots for mounting to a wall surface.

11. The storage device of claim 1 further comprising a pedestal and a post extending upwardly therefrom, the post mounting to the base plate thereby providing allowing the storage device to be mounted on a horizontal surface.

12. A storage device for storing and protecting face protection equipment comprises:

a base plate, a cover and a hinge rotatably mounting the cover to the base plate, the cover having a central dome and a rim extending about the periphery of the central dome, the hinge being mounted to the top of the cover, a space defined by the central dome and the base plate sized to cover an article of face protection equipment, the cover having an open position whereby the space is accessible and a closed position whereby the space is not accessible, a latch positioned opposite the hinge to engage the rim in the closed position thereby preventing unwanted movement of the cover, and one or more J-hooks to releasably mount one or more articles of face protection equipment to the base plate in the space.

13. The storage device of claim 12 wherein the hinge is mounted to the side of the cover.

14. The storage device of claim 12 adapted to mount to a surface.

15. The storage device of claim 14 having slots for mounting to a surface.

16. The storage device of claim 12 further comprising a pedestal and a post extending upwardly therefrom, the post mounting to the base plate thereby providing allowing the storage device to be mounted on a horizontal surface.

17. A storage device for storing and protecting face protection equipment comprises:

a base plate, a cover and a hinge rotatably mounting the cover to the base plate, the cover having a central dome and a rim extending about the periphery of the central dome, a space defined by the central dome and the base plate sized to cover an article of face protection equipment, the cover having an open position whereby the space is accessible and a closed position whereby the space is not accessible, a latch positioned opposite the hinge to engage the rim in the closed position thereby preventing unwanted movement of the cover, one or more J-hooks to releasably mount one or more articles of face protection equipment to the base plate in the space, and a tripod mount having a slidable post extending upwardly from a collar, the slidable post engaging one or more mounting brackets affixed to the rear of the base plate.

18. The storage device of claim 17 wherein the latch is a hook and loop fastener.

* * * * *